United States Patent [19]

Guala

[11] Patent Number: 4,550,845

[45] Date of Patent: Nov. 5, 1985

[54] BOTTLE CLOSURE

[75] Inventor: Piergiacomo Guala, Alessandria, Italy

[73] Assignee: Angelo Guala S.p.A., Alessandria, Italy

[21] Appl. No.: 704,505

[22] Filed: Feb. 22, 1985

[30] Foreign Application Priority Data

Feb. 24, 1984 [IT] Italy ..... 19789 A/84

[51] Int. Cl.[4] ..... B65D 41/34

[52] U.S. Cl. ..... 215/252

[58] Field of Search ..... 215/252

[56] References Cited

U.S. PATENT DOCUMENTS 3,650,428 3/1972 Miller ..... 215/252
4,458,817 7/1984 Guala ..... 215/252
4,488,655 12/1984 Itsubo et al. ..... 215/252
4,494,664 1/1985 Guala ..... 215/252

*Primary Examiner*—Donald F. Norton
*Attorney, Agent, or Firm*—Fleit, Jacobson, Cohn & Price

[57] ABSTRACT

A bottle closure, designed to make apparent any previous opening, consists of a cap, a collar extending coaxially in elongation of the cap, a line of weakness between the cap and the collar. A plurality of tabs project inwardly from the collar and are arranged close to the line of weakness and designed to engage in a circumferential recess which is made on the inside of the cap in proximity to the line of weakness, serving as a bridge across the line of weakness. When the cap is removed from the collar the tabs snap out of the recess and cannot re-enter it, so that a fissure is visible between the cap and the collar, showing that the cap has been removed.

3 Claims, 5 Drawing Figures

BOTTLE CLOSURE

This invention provides a bottle closure designed to make apparent any previous opening.

As is already known, when bottles are placed on sale, for example in a supermarket, there is a possibility of their being interfered with dishonestly, that is, opened and reclosed after being tampered with or part of the contents removed. For the protection of the consumer it is desirable that the bottle should bear obvious signs of any tampering, so that the purchaser may be aware of it. To this end various types of bottle closures are available which, in fact, once opened and then correctly reclosed, retain evident signs that opening has occurred.

One example of a known closure designed to make apparent previous opening is that described in the French Patent No. 1,594,879. In this closure a cap terminates in a plurality of outwardly facing hooks which, at the moment of the closure being applied to the bottle, engage the inside of a seating ring which in turn is secured on to the neck of the bottle, the hooks being trapped radially between the said seating and the bottle. Opening the bottle by unscrewing of the cap can only take place by previously breaking the ring.

Another example of a known closure of the kind referred to is that described in the Canadian Patent No. 1,117,072. In this closure the cap receives a ring having a U-shaped cross-section. When the closure is applied to the bottle the inner lip of U-shaped ring rides over an inclined surface made in the neck of the bottle and snaps into an annular seating in the said neck. Upon the first unscrewing of the cap it separates from the U-section ring, which is retained in the seating. When the cap is screwed on again it does not reassume its original position, but is stopped by the outer lip of the U section ring, which has in the meantime widened elastically.

Such known closures, although satisfactory from various viewpoints and substantially answering their purpose, nevertheless suffer from the acknowledged disadvantage of being complicated in construction, and being made up of several component parts. Moreover these parts either have to be previously assembled and then finally fitted together on the bottle, or they have to be suitably assembled successively upon the bottle. As a result the closure has a high manufacturing cost and is also expensive to fit to a bottle.

The fundamental object of this invention is to provide a bottle closure which satisfies the requirement of making evident any opening of the bottle while at the same time overcoming the disadvantages referred to concerning closures of the prior art.

This object is achieved by a bottle closure according to the invention which is characterised in that it comprises, in a single piece, a cap having an internal thread, a collar extending coaxially in continuation of the cap and having internal axial teeth and a circumferential internal ridge, a line of weakness between the cap and the collar, a circumferential recess on the inside of the cap in proximity to the line having a saw-tooth cross section and defining within the cap an annular trapezoidal section portion and a plurality of tabs projecting inwardly from the collar, arranged circumferentially in proximity to the line of weakness and designed to engage in the said recess, serving as a bridge across the line of weakness.

Further characteristics and advantages of the seal according to the invention will emerge from the following description, given by way of non-limiting example with reference to the accompanying drawings, in which.

Figure 2:
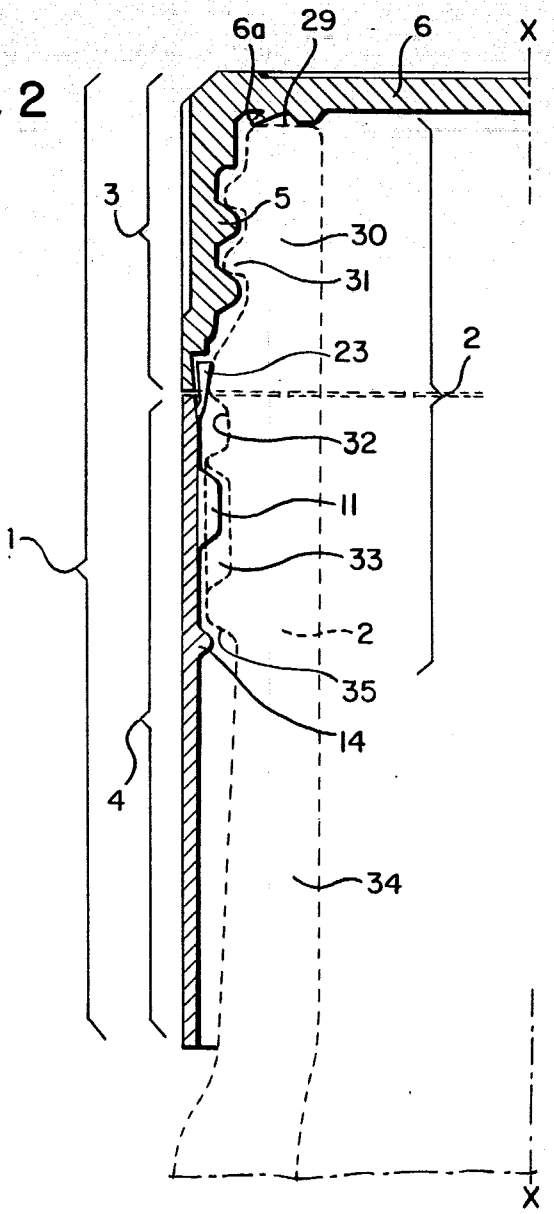
FIG. 2 is an axial sectional view of one detail of the closure of FIG. 1, in a first working position of use.

Referring to the drawings, a closure generally indicated 1 according to the invention is designed for a bottle 2 shown in broken outline.

The closure 1 consists of a single piece, produced by molding from a suitable plastics material such as polypropylene, and comprises a cap 3 with an axis X—X and a tubular cylindrical collar 4 extending coaxially with and in continuation of the cap 3.

More particularly the cap 3 has a tubular cylindrical skirt 5 closed at one end by a base 6 provided internally with an annular sealing lip 6*a*. The skirt 5 is provided with an internal right-hand screw thread 7.

The collar 4 extends in continuation of the tubular skirt 5 and is connected to the latter circumferentially by a line of weakness 8.

The line of weakness 8 is formed conventionally by a plurality of incisions indicated 9 which define between one incision and the next a plurality of small breakable bridges indicated 10.

The collar 4 has a plurality of axial teeth indicated 11, distributed circumferentially on the inside of the collar. The axial teeth 11 have a cross-section, in a transverse plane perpendicular to the axis X—X, of saw-tooth shape, having a frontal breast 12 and an inclined ramp-shaped back 13.

The collar 4 has moreover an inner circumferential ridge 14 positioned between the axial teeth 11 and the free edge of the collar.

The closure 1 according to the invention further includes a circumferential recess 15 of predetermined width made on the inside of the tubular skirt 5 of the cap 3, in proximity to the line of weakness 8. The recess 15 has a saw-tooth cross-section with a frontal wall 16 facing towards the mouth of the cap 3 and an inclined back wall 17 facing towards the inside of the cap 3.

The recess 15 defines within the tubular skirt 5 of the cap 3 an annular portion 18 having a trapezoidal cross-section with its larger base 19 coinciding with the line of weakness 8.

On the inside of the recess 15 there are distributed at regular circumferential intervals a plurality of unidirectional stops 20, four in the example illustrated.

The stops 20 have a saw-tooth cross section in a plane perpendicular to the axis X—X, with a frontal breast 21 and an inclined back 22. It must be observed that the saw-tooth section of the unidirectional stops 20 is orientated in the opposite direction to the saw-tooth section of the axial teeth 11.

The closure 1 also comprises a plurality of tabs, equal in number to number of stops 20, indicated 23, projecting internally from the collar 4. The tabs 23 are arranged at regular circumferential intervals, in proximity to the line of weakness 8. Each tab 23 has a free edge 24 and a root 25, the thickness of the tab decreasing progressively from the free edge 24 to the root 25.

The thickness of each tab 23 at the root 25 is sufficiently small to enable the tab 23 to flex elastically at the root 24, in effect pivoting at the root 24. More particularly each tab 23 can be moved angularly from an inactive position as shown in FIG. 1, in which it is inclined towards the free edge of the collar 4, this position being that in which the tabs are made in the initial molding of the closure, to an engagement position shown in FIG. 2, in which it engages in the recess 15, serving as a bridge across the line of weakness 8.

The angular movement of the tabs 23 from their inactive positions to their positions of engagement in the recess 15 is resisted by self-resilience of the tabs 23, so that the tabs are resiliently urged towards their inactive positions. The tabs 23 are of a length slightly less than the width of the recess 15. In this manner when the tabs 23 are in their engagement positions they reach into the recess 15 for almost the whole of its width (FIG. 2).

In particular, the tabs 23 have a width approximately two to five times their length, and are staggered in relation to the stops 20. Consequently the tabs 23, when bent into their positions of engagement in the recess 15, are interpolated between adjacent steps 20.

Figure 1:
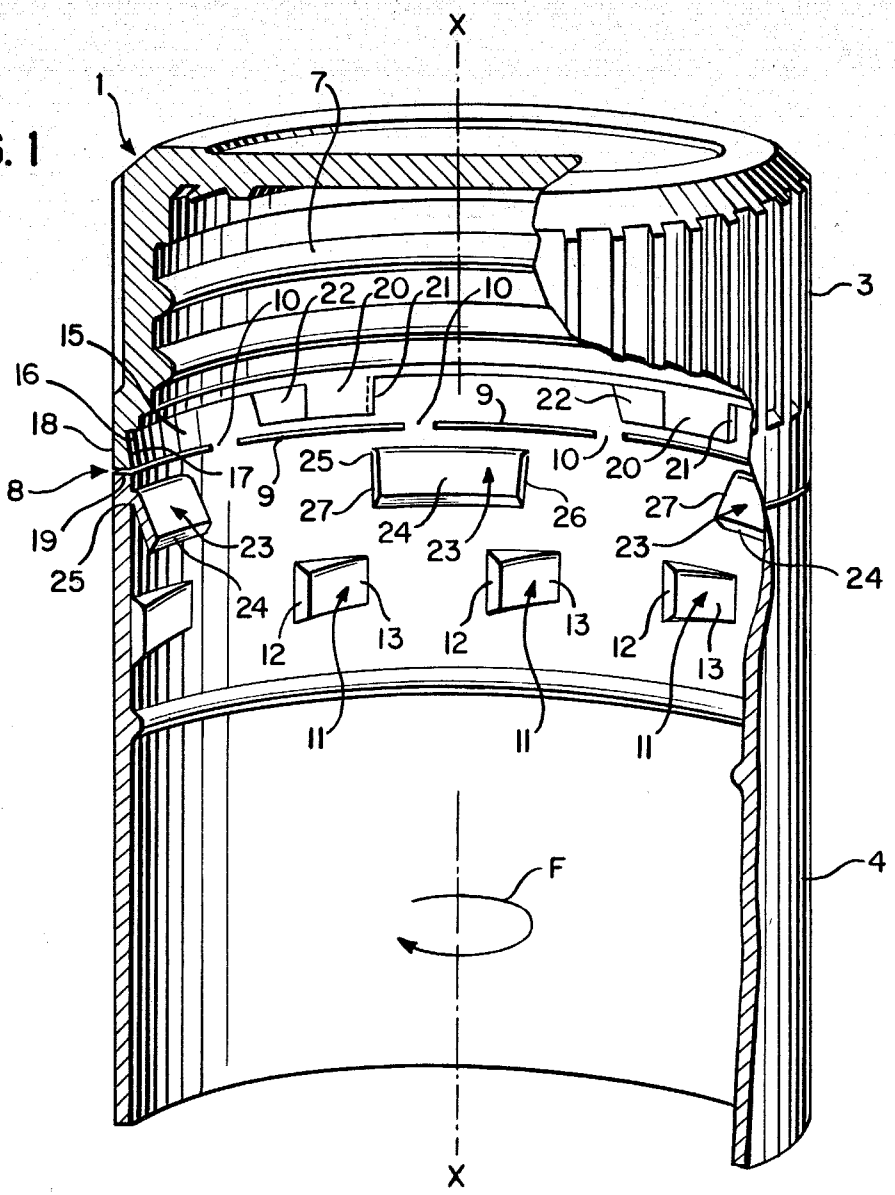
FIG. 1 is a perspective view partially cut away, of a closure according to one embodiment of the invention, in one of its rest positions.
Figure 5:
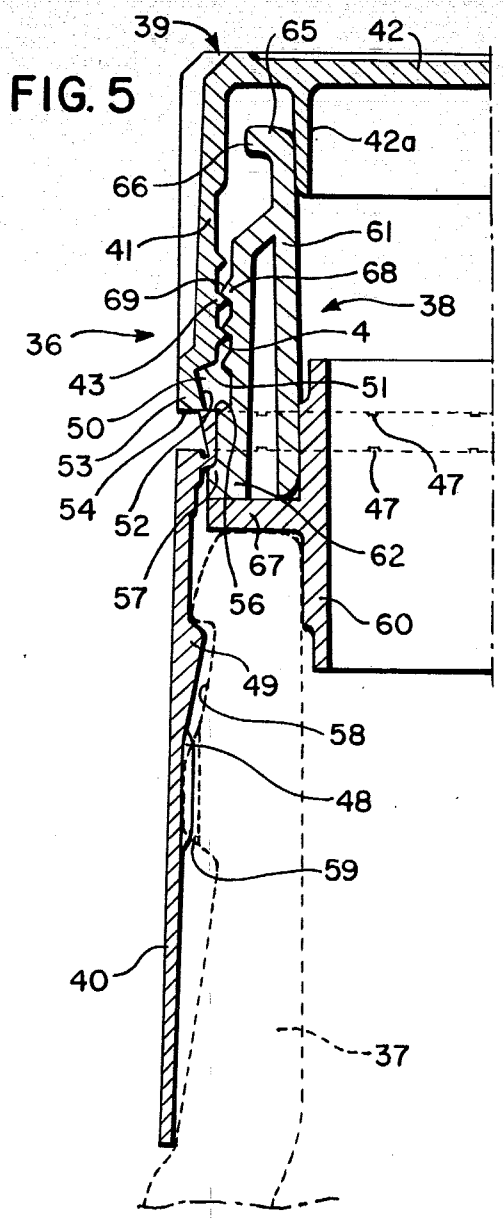
FIG. 5 is an axial section of the part of the closure of FIG. 4, in a second working position of use.

Each tab 23 has opposite circumferentially facing lateral walls, shown in the drawings as 26 and 27 and called respectively front and rear with respect to the forward direction of movement of the tab when the closure 1 is rotated clockwise around the axis X—X, as indicated in FIG. 1 by the arrow F.

When the tab 23 is in its engagement position it has its front lateral wall 26 facing the back 22 of the stop 20 which is ahead of the tab 23 with reference to the said forward direction F and has its rear lateral wall 27 facing the breast 21 of the stop 20 which is behind the tab 23 with reference to the said forward direction F.

It must be observed that the tabs 23 are positioned in relation to the stops 20 in such manner that when the tabs 23 are in their engagement positions the rear lateral wall 27 of each tab 23 is in contact with the breast 21 of the adjacent respective stop 20.

OPERATION

The operation and use of the closure 1 will be described with reference to the use of the closure 1 on a bottle 2, made of glass of which only the neck 28 is shown. The neck 28 has, starting from a free edge 29, a portion 30 provided with an external screw thread 31, an external circumferential groove 32, a plurality of axial teeth 33 distributed circumferentially around the neck and a narrow portion 34 of restricted section which defines an annular shoulder 35 facing towards said narrow portion 34.

The closure 1 is placed on the bottle 2 by screwing it on in the direction of the arrow F.

As the closure 1 is screwed onto the neck 28 of the bottle 2, the tabs 23, if they have not already been previously folded back by suitable equipment, are folded back by the said neck 28 from their inactive positions indicated in FIG. 1, to their engagement positions indicated in FIG. 2, in which they engage in the recess 15.

During the screwing on of the closure the axial teeth 11 engage, with their inclined backs 13, the teeth 33, so as to ride over them elastically with a snap action.

During screwing on the cap 3 rotates the collar 4 by virtue of the positive engagement of the breast 21 of each unidirectional stop 20 with the rear lateral wall 27 of the respective adjoining tab 23. In this way the line of weakness is safeguarded against overstressing which might cause its untimely rupture as the closure 1 is initially screwed onto the bottle 2.

When screwing-on is completed the base 6 of the cap 3 is in sealed abutment with the edge 28 of the neck 28, the internal thread 7 has engaged the external thread 31 of the bottle, the tabs 23 are held in engagement in the recess 15 of the cap 3, the teeth 11 are engaged with the axial teeth 33, causing the collar 4 to be fixed against rotation about the neck 28 in the opposite direction to the arrow F, and, finally, the ridge 14 has snap-engaged in the narrow portion 34 beyond the shoulder 35.

When the bottle 2 is first opened the cap 3 is unscrewed and is separated from the collar 4, which is prevented from rotating by the engagement of the breasts 12 of the teeth 11 with the teeth 33. Upon separation the breakable bridges 10 are ruptured.

During unscrewing of the cap 3 each stop 20 encounters, with its inclined back 22, the front lateral wall 26 of each tab 23, and successively snaps over it.

In separating, the annular portion 18 of the cap 3 snaps over the tabs 23, which leave the recess 15.

Once the cap 3 has been removed, pouring out can take place. During pouring the collar 4 is held back from leaving the neck by the engagement of the projection 14 in the shoulder 35.

In order to close the bottle the cap 3 is screwed on again. When this is done, the annular portion 18 reaches and abuts, by the greater base part of its trapezoidal section, the free edges 24 of the tabs 23 and through the said tabs 23, point-stressed at their free edges 24, the collar 4, inducing further movement of the latter onto the neck of the bottle.

It will be noted that during this last movement of the collar 4 the tabs 23 engage, by their self-resilience, in the groove 32.

Figure 3:
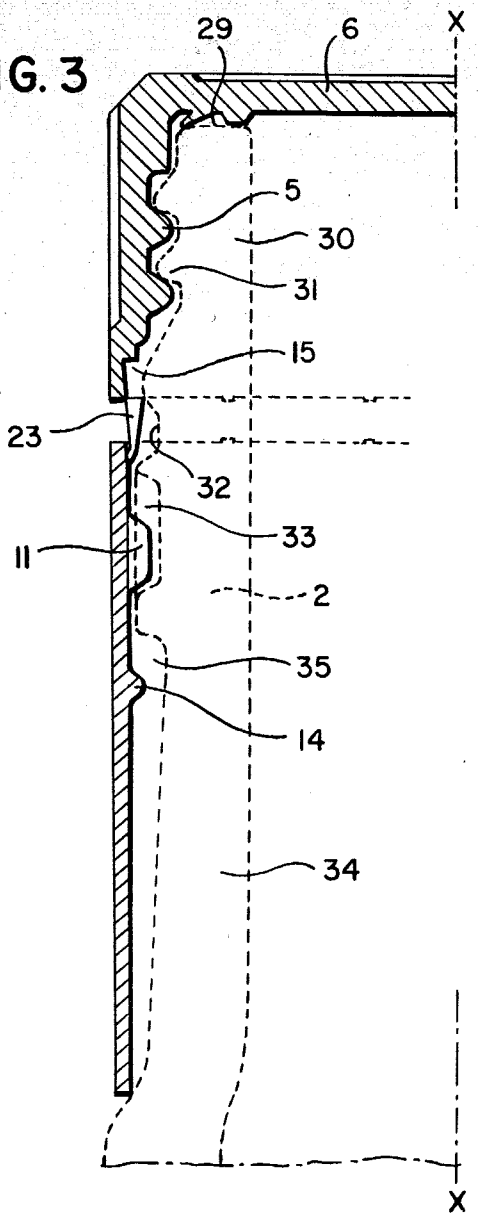
FIG. 3 is an axial sectional view of the said detail of FIG. 2, in a second working position of use.

When the cap 3 has been completely screwed on, an annular fissure is formed between the cap 3 and the collar 4, having a width substantially equal to the length of the tabs 23 (FIG. 3). This fissure makes it apparent that the bottle has been opened. Moreover, the tabs 23 will be clearly visible through the fissure, arranged at regular intervals; this is further visible evidence of the bottle having been opened.

Upon each successive reopening of the bottle and when pouring from the bottle, the collar 4 is prevented from making a return movement by the fact that the tabs 23 have engaged in the groove 32.

VARIANTS OF FIGS. 4 AND 5

Figure 4:
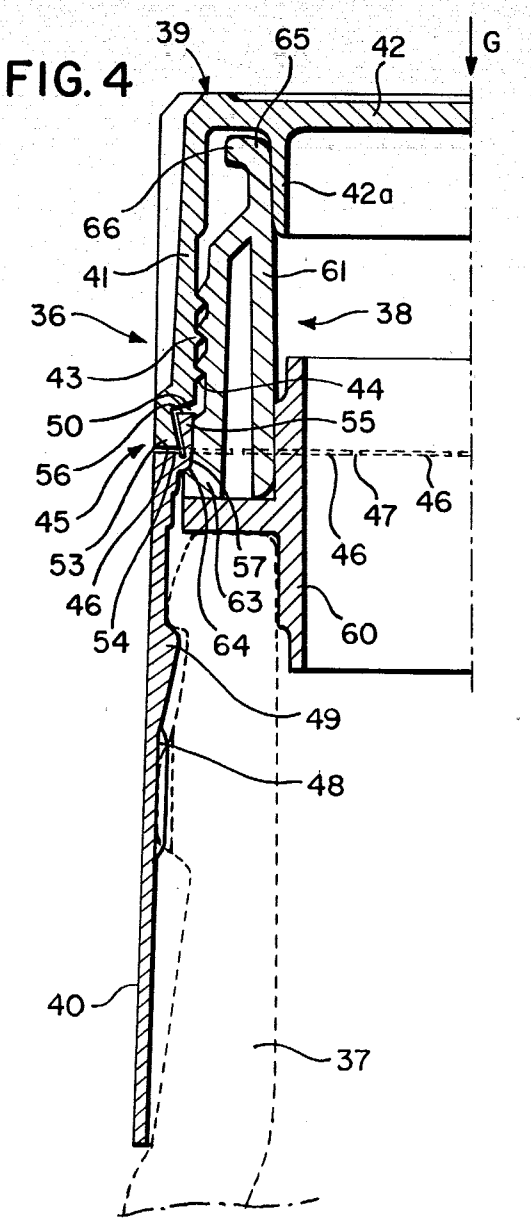
FIG. 4 is an axial sectional view of one half of a closure according to the invention, showing a variant embodiment, in a first working position of use.

Referring to FIGS. 4 and 45, there is indicated generally 36 a closure according to the invention, for a bottle 37 shown in the drawings in broken outline, equipped with a drip-proof pourer indicated generally 38.

The closure 36 consists of a single piece, made by molding, of a suitable plastics material such as polypropylene. The closure comprises a cap 39 with an axis X—X, and a tubular cylindrical collar 40 extending coaxially with and in continuation of the cap 39. More particularly the cap 39 has a tubular skirt 41 closed at one end by a base 42 equipped coaxially with a tubular appendage of small thickness **42*a*. The skirt 41 has an internal right-hand screw thread 43**.

The thread 43 has a saw-tooth section, with its oblique side 44 facing towards the mouth of the cap 39.

The collar 40 extends in continuation of the tubular skirt 41 and is connected to the latter by a circumferential line of weakness 45. The line of weakness 45 is formed in the traditional manner by a plurality of incisions indicated 46 between which are defined a plurality of small breakable bridges indicated 47.

The collar 40 has a plurality of axial teeth all indicated 48 distributed circumferentially on the inside of the collar.

The collar 40 also has a circumferential ridge 49 positioned between the line of weakness 45 and the plurality of axial teeth 48.

The closure 46 according to the invention further includes a circumferential recess 50 of predetermined width made on the inside of the tubular skirt 41 of the cap 39 in proximity to the line of weakness 45.

More particularly the recess 50 has a saw-tooth section which has a front wall 51 facing towards the mouth of the cap 39 and an oblique wall 52 facing twoards the inside of the cap 39.

The recess 50 defines, within the tubular skirt 41 of the cap 39 an annular portion 53 having a trapezoidal section with its greater base 54 coinciding with the line of weakness 45.

The closure 46 moreover comprises a plurality of tabs 55, four in this example, projecting from the collar 40 towards the inside of the latter. The tabs 55 are arranged at regular intervals circumferentially, in proximity with the line of weakness 45.

Each tab 55 has a free edge 56 and a root 57 and its thickness diminishes progressively from the free edge 56 to the root 57. The thickness of each tab 55 at its root 57 is sufficiently small to enable the tab 55 to flex resiliently around the root 57.

More particularly the tabs 55 may be moved angularly from an inactive position, in which they are inclined towards the free edge of the collar 40, this position being that in which the tabs are made at the time of molding of the closure, to an engaged position, shown in FIG. 4, in which they engage in the recess 50, serving as a bridge across the line of weakness 45.

The aforesaid angular movement of the tabs 55 from their inactive to their engaged positions is resisted by the self-resilience of the tabs 55 which urges the tabs 55 constantly towards their inactive positions.

The tabs 55 have a length slightly less than the width of the recess 50. Thus when the tabs 55 are in their engaged positions, they extend into the recess 50 for almost the entire width of the latter.

The operation and use of the closure 36 will be described with reference to its engagement on the bottle 37 fitted with the non-drip pourer 38.

For this purpose the bottle 37 is provided near its mouth with an annular external groove 58 and with a plurality of axial teeth 59 distributed circumferentially in the proximity to the groove 58.

The non-drip pourer 38 consists of a tubular sleeve 60, made of polystyrene joined to the bottle, and a tubular body 62, also made of polystyrene, which has at one end 62 an annulr bead 63 which defines a shoulder 64 and at the opposite end 66 an annular non-drip lip 65.

The sleeve 60 has half-way along its length an external flange 67, the sleeve 60 being inserted with a predetermined force into the bottle 2 until the flange 67 abuts the moutn of the bottle 37.

The tubular body 61 is force-fitted onto the sleeve 60 until its edge 63 abuts the flange 67.

An external thread 68 is formed on the tubular body 61, mating with the internal thread 43 of the cap 39. The thread 68 has a saw-tooth section with its oblique side 69 facing towards the non-drip lip 65.

The closure 36 is fitted to the bottle 2 and on the pourer 38 by axial push-fitting, forcing the closure 36 axially in the direction of the arrow G.

At the time of fitting of the closure 36, the tabs 55, if they have not already been folded back by suitable equipment, are folded back by the tubular body 61 from their inactive positions into their engaged positions, indicated in FIG. 4, in which they engage in the recess 50.

When the fitting-on of the closure is completed the base 42 of the cap 39 is sealingly engaged in tubular body 61 by fitting the tubular appendage **41*a* into the said tubular body 61. In addition the thread 43 has snap-engaged the thread 68; the tabs 55 are held in engagement in the recess 50 by the tubular body 61 and have their roots 57 abutting against the should 64; the axial teeth 48 are engaged with the axial teeth 59 coupling the collar 40 with the bottle 37, and finally the ridge 49 has snap-engaged into the annular groove 58**.

Upon the first opening of the bottle, the cap 39 is unscrewed and it is separated from the collar 40 which is prevented from rotating by engagement of the teeth 48 and 59 with each other.

Upon such separation the breakable bridges 47 are ruptured. In addition, the annular portion 53 of the cap 39 snaps over the tabs 55, which leave the recess 50.

When the bottle is opened, pouring out can be effected. During pouring the collar 40 is held back from coming off the bottle by being engaged with the shoulder 49 in the groove 58.

In order to close the bottle one screws the cap 39 on again. By doing this the annular portion 53 reaches and engages with the larger portion of the base of its trapezoidal section the free end 56 of the tabs 55 and is stopped against them.

There is thus formed between the cap 39 and the collar 40 an annular fissure of a width substantially equal to the length of the tabs 55. This fissure makes it apparent that the bottle has been opened.

Through the aforesaid fissure the tabs 55 can be seen, arranged at regular intervals, and this is further visual evidence of opening having occurred.

The seal according to this invention is very simple in construction, it does not require any assembly operation, being made in a single piece, and can be fitted speedily.

I claim:

1. Bottle closure of the kind comprising an internally threaded cap, a collar extending coaxially with and in continuation of the cap and having internal axial teeth and an internal circumferential ridge, and means defining a line of weakness between the cap and the collar wherein the improvement consists in:

the closure is made in a single piece, the cap is formed internally, in proximity to the line of weakness, with a circumferential recess having a saw-tooth cross-section and defining in the cap an annular portion of trapezoidal section, and a plurality of tabs projecting internally from the collar arranged circumferentially in proximity to the line of weakness, said tabs engaging in said recess to serve as a bridge across the line of weakness.

2. Bottle closure of the kind comprising an internally threaded cap, a collar extending coaxially with and in continuation of the cap, and means defining a line of weakness between cap and collar, wherein the improvement consists in:

the closure is made in a single piece, the collar has internal axial teeth of saw-tooth cross section and an internal circumferential ridge, the cap has an internal circumferential recess in proximity to the line of weakness, said recess having a saw-tooth section and defining in the cap an annular portion of trapezoidal section, a plurality of saw-tooth stops arranged at regular circumferential intervals within the said recess, and a plurality of tabs projecting internally from the collar, arranged circumferentially in proximity to the line of weakness and designed to engage in said recess and to engage said unidirectional stops, said tabs serving as a bridge across said line of weakness.

3. Closure as defined in claim 1, wherein said tabs are resilient and are resiliently loaded when engaged in said recess.

* * * * *